United States Patent [19]

Smith

[11] 4,331,019

[45] May 25, 1982

[54] DEVICE FOR CRIMPING TUBULAR ELEMENTS

[75] Inventor: John L. Smith, Bedford, England

[73] Assignee: Andrew Hydraulics International Limited, Bedford, England

[21] Appl. No.: 84,124

[22] Filed: Oct. 12, 1979

[51] Int. Cl.[3] ..... B21D 7/06

[52] U.S. Cl. ..... 72/402; 29/237; 72/32; 72/453.15

[58] Field of Search ..... 72/402, 32, 36, 453.15, 72/453.16, 453.03, 415, 416, 452; 29/237

[56] References Cited

U.S. PATENT DOCUMENTS

| | | | |
|---|---|---|---|
| 3,335,594 | 8/1967 | Peterman | 72/402 |
| 3,568,494 | 3/1971 | Geisman | 72/402 |
| 3,768,298 | 10/1973 | Olive-Jones | 29/237 |
| 4,071,936 | 2/1978 | Smith | 29/237 |
| 4,189,817 | 2/1980 | Moebius | 29/237 |

FOREIGN PATENT DOCUMENTS

| | | |
|---|---|---|
| 892222 | 3/1972 | Canada . |
| 962094 | 6/1964 | United Kingdom . |

*Primary Examiner*—Gene P. Crosby
*Attorney, Agent, or Firm*—Cooper, Dunham, Clark, Griffin & Moran

[57] ABSTRACT

A crimping device is disclosed having a plurality of dies driven by a camming action toward a central axis so that an article between the dies can be crimped. A hydraulic actuator is provided for causing the camming action for moving the dies. An adjusting member forming a stop is provided for defining an end-of-stroke position of the hydraulic actuator for adjustment of the radial spacing between the dies.

6 Claims, 2 Drawing Figures

DEVICE FOR CRIMPING TUBULAR ELEMENTS

FIELD OF THE INVENTION

This invention relates to devices for crimping or swaging fittings onto members such as pipes and tubes. Although it is normally a pipe or a tube to which a fitting is applied by the use of such device, in principle the member to which a fitting is applied need not be hollow, nor cylindrical. The devices with which the invention is concerned will be referred to as crimping devices throughout this specification.

BACKGROUND OF THE INVENTION

A common use for crimping devices is to apply couplings to the ends of hydraulic hoses. A common form of coupling consists of a tubular body portion surrounded by a tubular shell portion, with an annular space between them. The end of a hose is pushed over the body portion into the space between it and the shell portion, and then the shell portion is crimped radially inwards to squeeze the end of the hose tightly between the shell portion and the body portion, thereby firmly securing the coupling to the hose.

It is well known that it is for practical purposes important that at the end of the crimping operation the outside of the crimped article should have been brought to a predetermined desired outside diameter.

British Patent Specification No. 962,094 describes a crimping device of a kind which has been commonly used but has various disadvantages. It is fitted with a gauging device which is intended to enable crimping accurately to a given outside diameter. However, the gauging device is located well off the central axis of the crimping device and for that reason its accuracy is adversely affected by any mis-alignment or distortion of the components of the device. Additionally, it is difficult to set the rotatable gauging element 22 accurately by eye. To assist in this, in practice a short graduated scale about 1" long has been located on the device adjacent to member 22 so that the member 22 can be rotated until its top corresponds with any desired selected one of the markings on the scale. However, because of the shortness of the scale this does not enable the member 22 to be set very accurately. Furthermore, the setting of the gauging member 22 did not actually predetermine the outside diameter that would be achieved at the end of the crimping operation, but only provided the operator of the device with a reference against which he would have to judge by eye when the desired outer diameter had been reached, recognising this situation as being when the top of the other gauging member 21 had reached a position flush with the top of the gauging member 22. He would have to stop the operation of the device as soon as he perceived that this situation had been reached. Of course, judgement and action of this type is not of great accuracy.

Canadian Pat. No. 896,222 discloses a crimping device which has similar problems.

SUMMARY OF THE INVENTION

An object of the present invention is to provide an improved crimping device.

From one aspect, a crimping device in accordance with the invention comprises a plurality of dies disposed round an axis, camming means for driving the dies towards the axis by a camming action so that an article between the dies can be crimped, a hydraulic actuator for causing axial relative movement between the dies and the camming means, said actuator having an output member, said output member extending through a threaded bore, and an annular adjusting member encircling said output member and threadedly mounted in said threaded bore so as to be selectively positionable in the axial direction, the output member including abutment means positioned to contact the adjusting member at the end of the stroke of the actuator, the adjusting member thus forming a stop defining an end-of-stroke position of the hydraulic actuator, whereby to enable adjustment of the radial spacing which exists between the dies when the actuator has completed its stroke.

Normally, the device will be provided with die-holders which co-operate with the camming means, and interchangeable sets of dies of different sizes may then be fitted to the die holders. Alternatively, though in fact it would be relatively disadvantageous, the die holders could be omitted, and suitably formed dies provided on which the camming means would operate directly.

The term "dies" as used in the appended claims is intended to be inclusive of: (1) suitably formed dies as described in the preceding paragraph; and (2) die holders and dies connected thereto.

In a device according to the invention as just referred to, once the adjusting means has been set so as to provide a given stroke and hence a given spacing between the dies when at the end-stop position, then every time the device is operated it will, provided it is fully operated, necessarily crimp the article being crimped to the same outside diameter, without the need for any judgement or co-ordination by the operator.

The adjusting member may have a relatively large diameter angular scale thereon which co-operates with an index, so that when the adjusting member is rotated a relatively large movement of the scale relative to the index will occur for a small axial movement of the adjusting member, whereby the stroke of the actuator, and hence the final crimping diameter when the device is operated, can be accurately set by eye.

To further facilitate initial setting of the device, a second scale may be provided, extending in the axial direction and co-operating with the adjusting member, so that as the adjusting member moves axially, a portion thereof or a part attached thereto can move along the axial scale. In this case, the axial scale acts as a coarse setting scale and the angular scale acts as a fine setting scale, as will be more evident from the detailed description which follows.

BRIEF DESCRIPTION OF THE DRAWINGS

In order that the invention may be more clearly understood, a preferred embodiment thereof will now be described, by way of example, with reference to the accompanying drawings, in which.

DESCRIPTION OF AN EMBODIMENT

Figure 1:
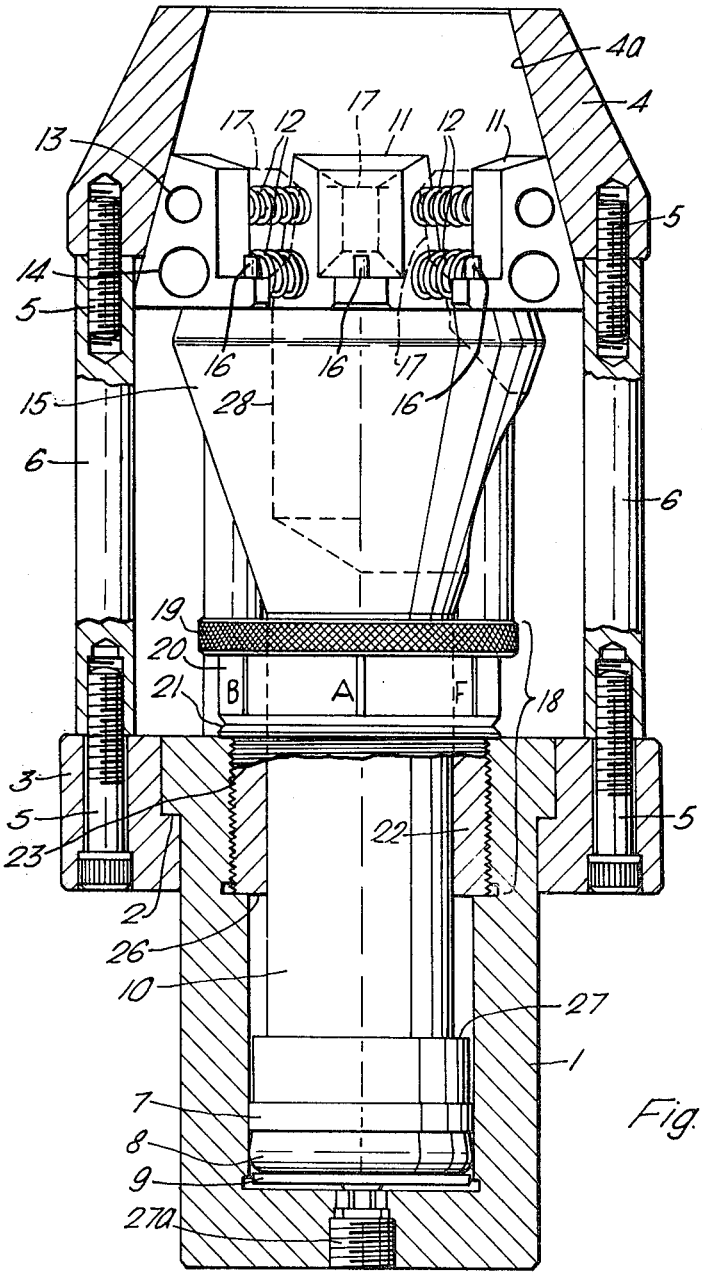
FIG. 1 is a longitudinal cross-section, intersecting the central axis, through a crimping device in accordance with the invention, in its starting position when adjusted to crimp down to a relatively large diameter.

The outer structure of the device comprises a hydraulic cylinder 1 engaging by means of shoulders 2 in a ring 3 which is secured to a crimping ring 4 having a conical internal surface 4a by means of bolts 5 and spacers 6 arranged around the device, which is generally symmetrical about its central axis.

Inside the hydraulic cylinder 1 there is a piston 7 provided with a seal 8 which is held against the lower end of the piston by means of a plate 9 suitably secured, for example by a central bolt, to the piston 7. The piston 7 is integral with a piston shaft 10.

A plurality of die holders 11 (of which only three are shown in each figure for simplicity) are angularly spaced around the inside of the crimping ring 4, and they are maintained in contact with its inner surface 4a by means of small coil springs 12 of which two are fitted between each two adjacent die holders, with their ends received in blind bores 13 and 14 in the sides of the die holders.

The die holders 11 are supported on the upper (as viewed) surface of a die base 15 which is integral with the top end of piston shaft 10.

Each of the die holders 8 is provided with a peg 16. Indicated in broken lines are dies 17 provided with sockets which enable them to sit on the pegs 16, and thereby be retained on the die holders. Sets of dies of different sizes may be provided so as to enable the device to have different crimping ranges.

A tension spring 16a (see FIG. 2) has its lower end suitably secured in any known manner to the bottom of the hydraulic cylinder 1 and its upper end is secured at the top end of an internal bore in the piston rod 10 (the bore not being shown), so that when the piston is in its lowest position as shown in FIG. 1 the spring is accommodated entirely within the bore. The purpose of the spring 16 is to bias the piston from the position shown in FIG. 2 towards the position shown in FIG. 1, so as to return the device to its starting position after each crimping operation.

Figure 2:
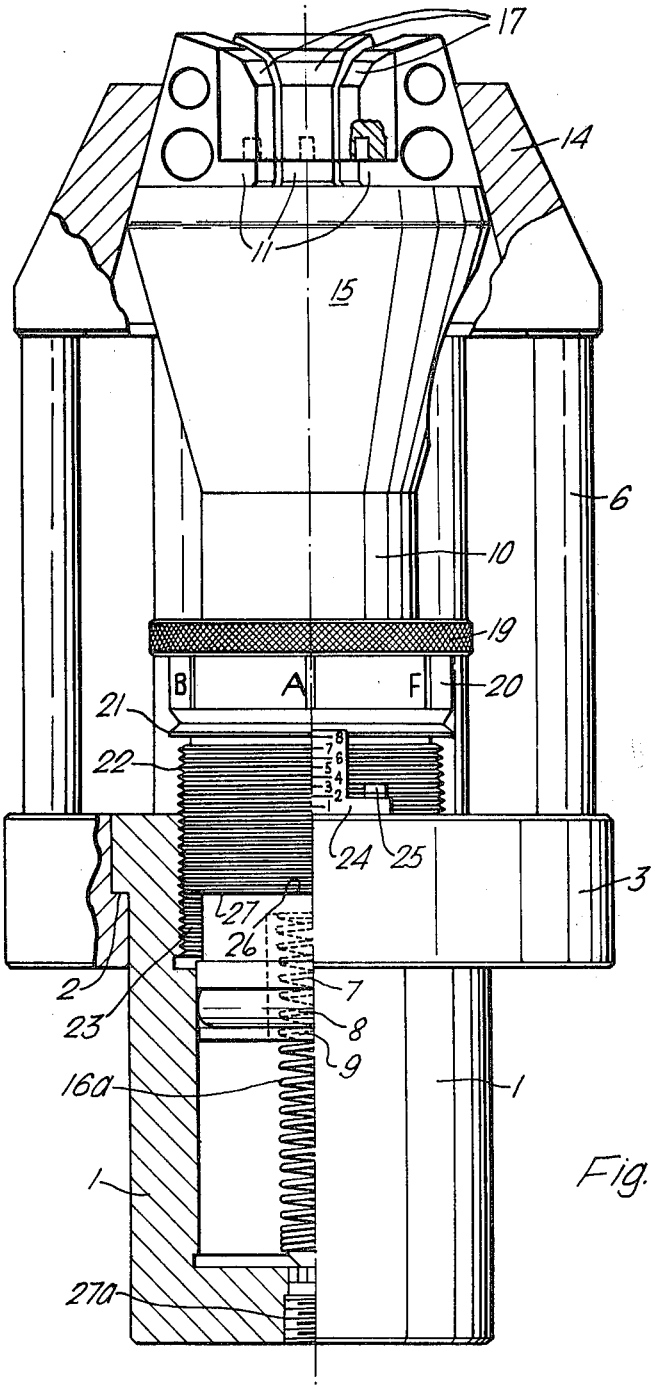
FIG. 2 shows a corresponding view of the device when it has been hydraulically operated to complete a crimping operation, but to a minimum diameter.

The piston rod 10 passes through the centre of an annular adjusting member 18 which has an upper knurled section 19 by which it can be rotated by hand, a scale portion 20 carrying equally spaced scale markings A to F around it (the markings thus being 60° apart), a lip 21 the function of which will be explained, and an externally threaded portion 22 by means of which the adjusting member 18 is threadedly mounted in an internal thread 23 adjacent the top end of the hydraulic cylinder 1. An axial scale carrying markings from 1 to 8, shown by reference 24 in FIG. 2, is secured to the upper end surface of the hydraulic cylinder 1 by means of, for example, a screw 25. The left hand edge of the scale 24 forms an index which co-operates with the angular scale formed on the portion 22 of rotatable adjusting member 18. The scale markings from 1 to 8 on the scale 24 co-operate with the lip 21 on the adjusting member, and preferably one of these scale markings is provided for each thread pitch, so that one complete rotation of the adjusting member 18 moves the lip 21 from one axial marking to the next.

In one practical embodiment, which is shown in the drawings, the pitch of the thread is $\frac{1}{8}''$. Consequently, for each full turn of the adjusting member 18 the lip moves across one scale graduation on axial scale 24. Also, each 60° rotation of the adjusting member 18, for example, from a position where the letter A on portion 20 is aligned with the flat left edge of scale 24 to a position where the letter B is so aligned, represents a 1/48" axial movement of the adjusting member 18.

It can thus be seen that the annular scale forms a fine adjustment scale and the linear scale 24 forms a coarse adjustment scale, and employing this system it is possible to define the various axial positions of the adjustment member 18, for the purposes of an operator, by a set of corresponding scale readings such as 1A, 1B, 1C, 1D, 1E, 1F, 2A, 2B etc.

The downwardly facing surface 26 of the adjustment member defines a positive end-of-stroke position for the piston 7, because when the device is operated the piston 7 rises until eventually a shoulder 27 thereon abuts the surface 26. The position to which the adjustment member 18 is set determines the final diameter to which an article will be crimped, as will become clear.

When the die-holders are in their starting position (FIG. 1) and adjusting member 18 has been set to provide the desired final crimped diameter, the article to be crimped, for example, a coupling on the end of a hose, is inserted through the upper end of crimping ring 4 until it lies between the opposed faces of the dies 17. Hydraulic fluid is then pumped into hydraulic chamber 1 below seal 8 through a suitable inlet port 27a and this drives piston 7, rod 10, and die base 15 upwards, so that the conical internal face crimping ring 4 causes the dies to be driven radially inwardly across the upper surface of the die base 15, thereby squeezing the coupling onto the hose.

The surfaces 26 and 27 eventually, as shown in FIG. 2, abut together and prevent further movement of the hydraulic ram. Clearly it is not possible to over-shoot the end-of-stroke position and therefore further crimping cannot occur once this position has been reached, and the outer diameter of the crimped article must therefore correspond with the initial setting of the adjusting member 18.

FIG. 1 shows the adjusting member 18 screwed into the cylinder 1 to a maximum extent, which provides the minimum possible stroke for the piston 7, and therefore the minimum radial displacement of the dies when the device is operated, and therefore the maximum final diameter of the article being crimped, after the device has been operated. FIG. 2 shows the adjusting member 18 screwed out of the hydraulic chamber 1 to the maximum extent, which provides the longest stroke for the piston 7, and hence the maximum radial inward displacement of the dies and the minimum final diameter of the article to be crimped. In FIG. 2 the piston 7 is shown having reached the end of its stroke with its surface 27 in contact with surface 26. It can be seen that the seal 8 is spaced far enough axially away from the surface 27 to prevent the seal from reaching as far as the threads 23 when the device is operated at maximum stroke as in FIG. 2.

It can be seen that the adjusting mechanism is concentric with the axis of the device and therefore problems which can occur with off-centre setting systems do not arise. Also, the adjusting system does not involve any projecting parts and therefore is not liable to damage.

Additionally, the device can be employed to crimp one end of an elbow fitting onto the end of a hose, in which case an open L-shaped passage 28 (shown in broken lines in FIG. 1) is provided in the die base 15 to accommodate the other end of the elbow fitting when it is being crimped onto the hose.

I claim:

1. A crimping device comprising a plurality of dies disposed round an axis, camming means for driving the dies toward the axis by a camming action so that an article between the dies can be crimped, a hydraulic actuator for causing axial relative movement between the dies and the camming means, said actuator having an output member, said output member extending through a threaded bore, and an annular adjusting member encircling said output member and threadedly mounted in said threaded bore so as to selectively positionable in the axial direction, the output member including abutment means positioned to contact the adjusting member at the end of the stroke of the actuator, the adjusting member thus forming a stop defining an end-of-stroke position of the hydraulic actuator, whereby to enable adjustment of the radial spacing which exists between the dies when the actuator has completed its stroke.

2. A crimping device as claimed in claim 1, wherein said output member includes a piston, the piston is located in a cylinder, and the threaded bore is co-axial with, and forms an extension of, said cylinder.

3. A crimping device as claimed in claim 1, wherein the adjusting member and a stationary adjacent portion of the device carry a cooperating datum mark and a peripherally extending scale.

4. A crimping device as claimed in claim 3, comprising a second scale extending axially and fixed adjacent to the adjusting member, the adjusting member having a datum portion thereon which cooperates with said second scale.

5. A crimping device as claimed in claim 1, comprising a spring co-axial with said output member for restoring the actuator from an end-of-stroke position to a beginning-of-stroke position.

6. A crimping device as claimed in claim 5, wherein said output member includes a piston, the piston is located in a cylinder, the spring is a tension spring, there is an axial bore in said output member, the spring being located between one end of said bore and an internal end of said cylinder.

* * * * *